US006229129B1

(12) United States Patent
Yoshida

(10) Patent No.: US 6,229,129 B1
(45) Date of Patent: May 8, 2001

(54) SWITCH ACCESS GUARD

(75) Inventor: Mark H. Yoshida, Glendale, CA (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 0 days.

(21) Appl. No.: 09/545,474

(22) Filed: Apr. 7, 2000

(51) Int. Cl.[7] ..... H05B 6/66

(52) U.S. Cl. ..... 219/702; 219/722; 219/724; 200/50.02; 200/50.08

(58) Field of Search ..... 219/722, 723, 219/724, 702; 200/50.02, 50.08, 50.09, 50.1, 50.12, 50.13, 50.14, 50.16

(56) References Cited

U.S. PATENT DOCUMENTS 3,733,456 * 5/1973 Blackburn ..... 219/724
4,504,719 * 3/1985 Taylor, Jr. et al. ..... 219/724
4,511,780 * 4/1985 Okamura ..... 219/724

* cited by examiner

*Primary Examiner*—Philip H. Leung
(74) *Attorney, Agent, or Firm*—Brooks & Kushman P.C.

(57) ABSTRACT

A method and apparatus for protecting an oven switch mounted in a retracted position that is engaged by a probe only when the oven door is closed. A post and a strap restrict access to the access entry, the strap forming a socket that receives an inserted projecting member and restricts its movement to a direction away from the direction of switch actuation. In the preferred embodiment, the strap is a resiliently five sheet metal strip mounted so that the unmounted end that is resiliently urged against the post restricting the access opening. Nevertheless, the access entry freely admits a probe, preferably carried by the door, that is resiliently biased to displacement in that direction and engages the retracted actuator arm of the retracted switch upon complete closure of the oven door.

7 Claims, 3 Drawing Sheets

SWITCH ACCESS GUARD

FIELD OF THE PRESENT INVENTION

The present invention relates to a method and apparatus for preventing undesired actuation of a microwave oven when the oven door has not been closed and to prevent tampering by inserting a protrusion within an access entry to overcome a retracted position switch.

PRIOR ART

Many previously known microwave ovens include switches that prevent actuation in the event that the microwave oven door has not been fully closed over the oven chamber. Often times, the oven door includes a probe that extends toward a restricted access opening in the oven body housing. The probe engages an enabling switch when the door reaches the fully closed position. Nevertheless, merely recessing the switch within the access opening provides the opportunity for tampering by insertion of a protrusion, such as a finger, not connected with the door even when the door is in a fully opened positioned.

Other previously known microwave ovens sought to avoid the undesired access of a recess switch by also mounting the switch in a position retracted from the access entry, so that mere insertion of a protruding member in the direction of the access entry opening will not actuate the enabling switch. However, tampering is often accompanied by manipulation of the protrusion from outside of the access entry whereby undesired engagement with the enabling switch may still be accomplished. As a result, the previously known devices have not succeeded in limiting access to an enabling switch where interlocks require complete closure of the oven door before the enabling switch is actuated.

SUMMARY OF THE INVENTION

The present invention overcomes the above mentioned disadvantages by providing a method and apparatus for protecting a switch mounted in a retracted position from an access entry by a directing strap that may be displaced in a direction away from the switch and carrying an inserted protrusion in a direction away from the switch. The obstructing member includes a socket for receiving an end of an inserted protrusion while permitting entry of a probe that may be displaced in a direction toward the switch after closure of the door for engagement of a probe part in the direction of the switch actuator.

In the preferred embodiment, an access entry in an oven body housing cavity receives a probe, attached to the door, and having a protruding member and a lateral prong or lobe that reaches in the direction toward the retracted switch position, for example, lateral to the direction of insertion. Preferably, the probe pivots as it is displaced in the direction of insertion, the pivoting movement being limited in the direction of switch actuation to when the door has been fully closed. A strap is mounted across the access entry to restrict access in the direction of switch actuation and intermediate the boundaries of the access entry. Preferably, a post is positioned at one end of the entry and the strap is mounted adjacent to an opposite end of the access entry. The mount resiliently urges the arm toward the post, but is pivotable in a direction not aligned with a switch actuator for the retracted switch. The arm includes a socket that receives any inserted protrusion and carries the protrusion in the direction of arm displacement.

As a result, any attempt to operate the microwave when the door is opened by attempting to reach the retracted switch position with a protrusion such as a finger, utensil or the like effectively limits the protrusion to a direction that does not approach the direction of switch actuation. As a result, the present invention foils attempts to override enabling switches that have been retracted from an access entry and associated barriers which may be subjected to tampering. Accordingly, the guard of the present invention protects against inadvertent insertion of a finger, tool or other inserted protrusion that is not designed in conformity with the probe that may travel in the direction of switch actuation only when the microwave door has been closed.

BRIEF DESCRIPTION OF DRAWINGS

The present invention will be better understood by reference to the following detailed description of a preferred embodiment when read in conjunction with the accompanying drawing, in which like reference characters refer to like parts throughout the views, and in which.

DETAILED DESCRIPTION OF THE PREFERRED EMBODIMENT

Figure 1:
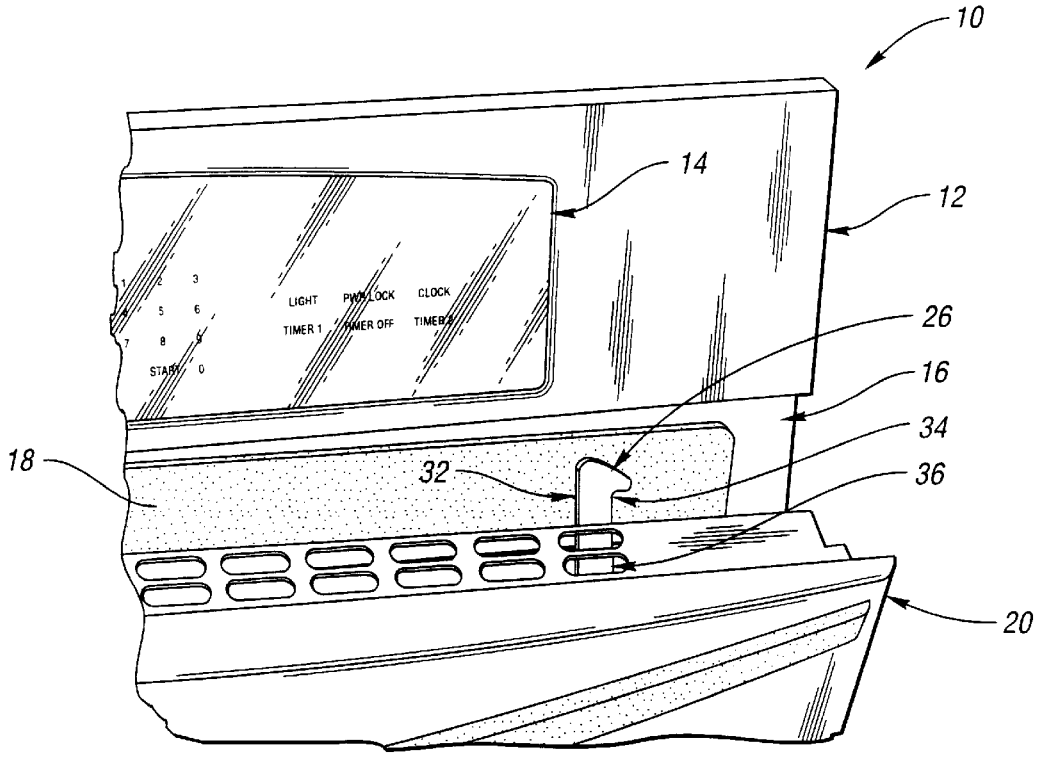
FIG. 1 is a perspective view of an oven constructed in accordance with the present invention.

Referring first to FIG. 1, an oven 10 is defined by an oven body 12 carrying at least one cooking energy source (not shown) as well as a control panel 14 including controls for each of the heating sources and various accessory operations. The control panel 14 is mounted on a housing 16 defining an oven chamber 18 which can be closed by a door 20. The door 20 is suitably mounted by a hinge or other displacement mechanism, for example, the pivot brackets 22 shown as in FIG. 3. Preferably, one of the heating sources is a microwave cooking energy source, although other sources may be likewise controlled. The switch mechanism 24 (FIG. 3) to be discussed in greater detail hereinafter is particularly beneficial for use in microwave ovens, although oven 10 is not so limited. Morever, in the preferred embodiment, a microwave cooking energy source 21 is combined with convection or other conventional heaters that multiply the techniques available for preparation of a cooked food product placed in the oven chamber.

Figure 2:
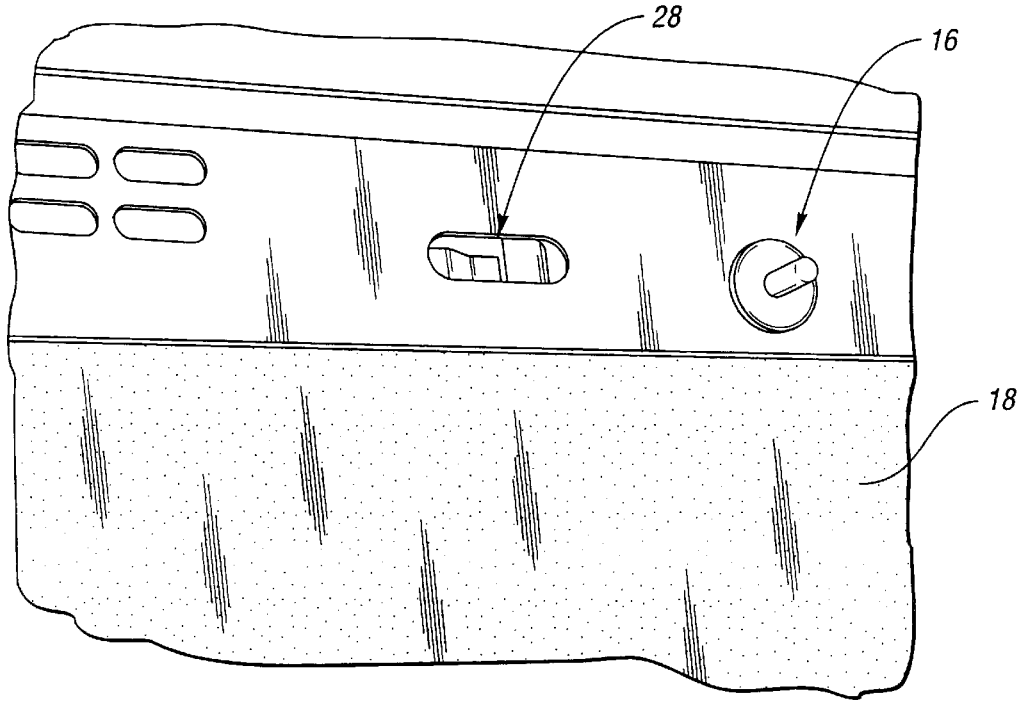
FIG. 2 is a perspective view showing the oven with the door opened and from a perspective position below that shown in FIG. 1.

As also shown in FIG. 1, a displaceable edge of the door, for example, the top as shown in FIG. 1, includes a probe 26 as part of an enabling or interlock latch mechanism 24. As with previously known latch mechanisms, the probe enters an access entry 28 (FIG. 2) in the housing 16, defined in part by the recessed position of the switching arrangement 44. The access entry 28 leads to interaction of the probe 26 with at least one switch actuator in the switch arrangement 44 enabling at least one of the cooking sources to be empowered after the door closes the cooking chamber. The present invention improves upon previously known latch mechanisms by retracting as well as recessing the switch actuator position in a different direction and limiting the type of movement that can reach the actuator.

Referring again to FIG. 1, the probe 26 includes a projecting arm 32 pivotally linked to the oven door at 36 and resiliently biased, for example by a coil spring or other biasing force, to the right in FIG. 1, so as to be aligned for insertion in the access entry 28. Nevertheless, the present invention provides discriminatory entry through the access entry 28 by limiting displacement in the direction of switch actuator movement.

Figure 3:
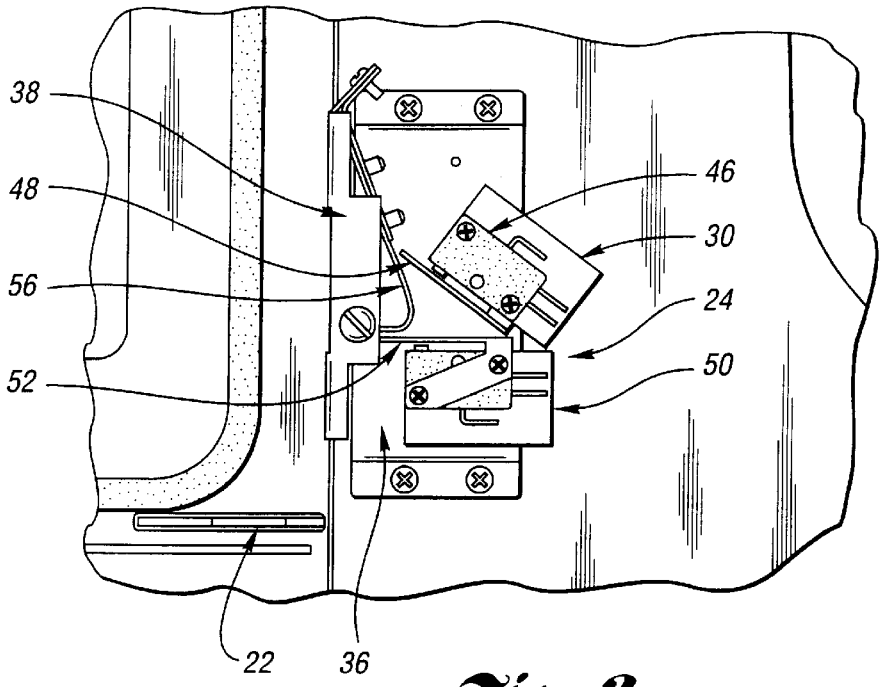
FIG. 3 is an enlarged plan view of a portion of the device shown in FIGS. 1 and 2 with parts removed for the sake of clarity.
Figure 6:
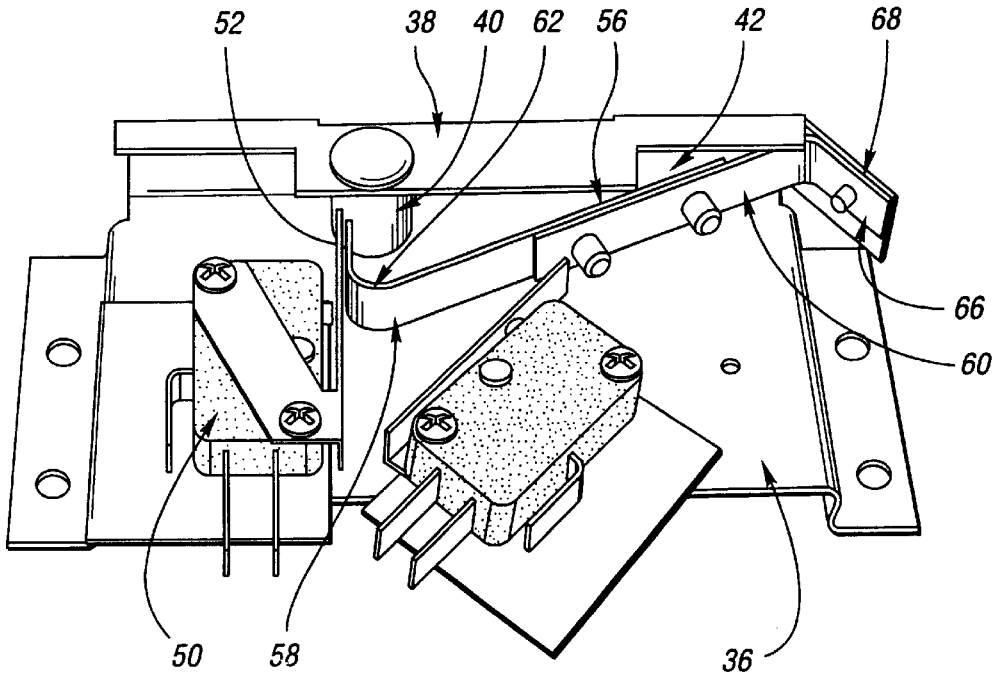
FIG. 6 is a rear perspective view of the plan as shown in FIGS. 3 through 5.

Referring now to FIG. 3, the access entry 28 is formed in part by bracket wall 36 and the spaced, parallel bracket flange 38 as well as a post 40 (FIG. 6) and an end wall 42 (FIG. 6) adjacent the access entry 28. In addition, strap 56, preferably in the form of a rigid arm 58 and mounting segment 60, is positioned to block free entry into the access entry 28 as will be described in greater detail below.

Referring again to FIG. 3, the switching arrangement 44 provides both a recessed and retracted switch position. In the preferred embodiment, the arrangement includes two switches 46 and 50 and the switch actuators 48 and 52, respectively, are aligned for displacement in different directions. Nevertheless, it is to be understood that a switch having multiple actuators, or additional switches, may be employed in a switching arrangement 44 having different directions of actuation without departing from the present invention.

Figure 4:
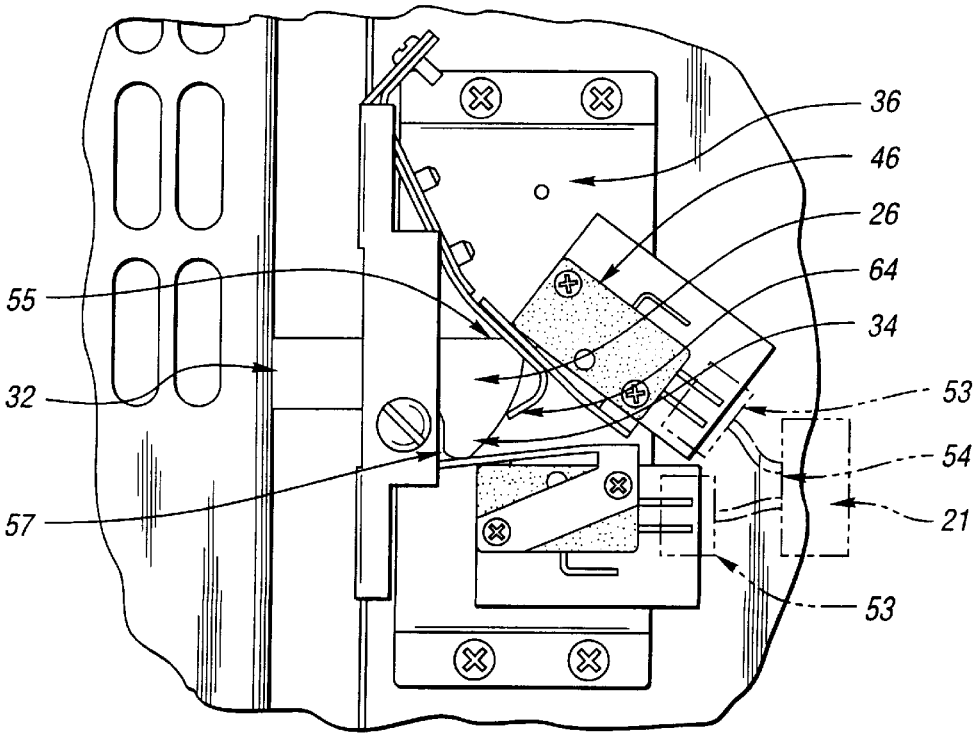
FIG. 4 is an enlarged plan view similar to FIG. 3 but showing the oven door in a closed position.

In the preferred embodiment, a first switch 46 is aligned at an angle so that a portion of its actuator arm 48 is positioned for engagement with the end of the probe 26 when the door is closed as shown in FIG. 4. In addition, a switch 50 is retracted from the access entry 28 for example, downwardly as shown in FIGS. 3 and 4, from the access entry 28. As a result, the actuator 52 of the switch 50 is positioned for displacement in a direction different than the insertion direction. As shown in FIG. 4, such positioning provides an enabling switch arrangement 44 that closes circuits by closing the actuators of the switches 46 and 50. For example, both switches may be closed and joined by couplers 53 to close a loop in a cooking energy source circuit 54 with the cooking energy source 21 shown diagrammatically in FIG. 4.

Accordingly, while insertion of a probe 26, which can pivot the lateral prong 34 of the probe 26 to displace the actuator 52 (for example, downwardly in FIG. 4) in a direction other than insertion through the access entry 28, in order to empower the cooking source, other inserted protrusions will not actuate the switches. The probe 26 may be particularly shaped, for example, as shown by the surface mating with the switch actuator 48 that displaces the prong 34 toward the actuator 52 of the switch 50. Alternatively, pivoting movement, or cam following type action of the edge 57 along the post 40, or the spring biased pivoting previously discussed, enable the probe 26 to actuate both recessed and retracted actuators.

The protector of the present invention includes a strap 56, preferably in the form of a rigid arm, made of a strip from a sheet of spring steel or other high temperature-resistant material. In the preferred embodiment, a first steel strip 58 having great resilience and shaperetaining capability includes a curved end portion forming a socket 62. A second steel strip forms a mounting portion strip 60, including a spring metal mounting flange 66 bolted, riveted or the like to a bracket flange 68 supported by the end wall 42. The strip 60 includes a bend, curve or other spring bias adjusting feature, as well as a strip connection portion which is secured to the curved strip 58. Although rivets are shown in the preferred embodiment, adhesives or a one piece construction may also be used to configure the strap 56 without departing from the scope of the present invention. In any event, from the pivot point near the mounting flange 66, the strap 56 extends across the access entry 28, and the resiliency in the mount urges the end 64 toward the post 40. In the preferred embodiment, the end 64 of the strip 58 may be urged into contact with the post.

Figure 5:
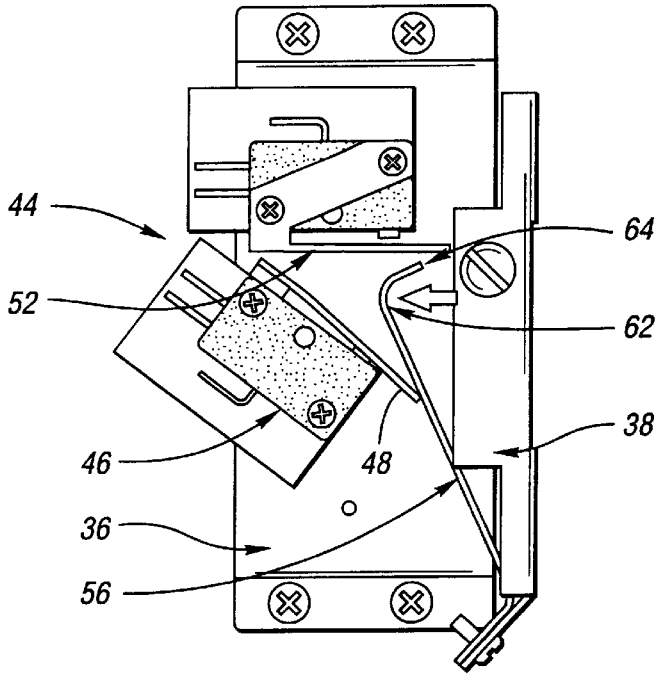
FIG. 5 is a plan view showing operation of the protector with an inserted protrusion according to the present invention.

Nevertheless, when any protrusion is inserted into the access entry 28, the protrusion contacts the strap 56 and becomes engaged in the socket 62. As shown in FIG. 5, further insertion or displacement of the protrusion such as a finger, displaces the strap in a direction away from the actuation direction of the actuator 52. Moreover, the strap carries the protrusion in the direction away from switch actuation for controlled displacement within the access entry. The displacement of an inserted protrusion away from the direction of the switch actuation to foils attempts to tamper with the empowering switch arrangement 44 when the cooking chamber 18 remains open. Nevertheless, in normal operation, the guarded switch is simply actuated by the probe 26 designed to close both recessed and retracted actuators that are actuated in different directions to enable power to be applied to a cooking energy source.

Having thus described the present invention, many modifications will become apparent to those skilled in the art to which it pertains without departing from the scope and spirit of the present invention as defined in the appended claims.

What is claimed is:

1. A protector for a switch mounted in a retracted position from an access entry receiving a probe, the protector comprising:

a post positioned at first end of said access entry, and said access entry having an opposite end;

a strap;

a mount for retaining a first end of said strap adjacent to said opposite end of said entry access, and resiliently urging an opposite end of said strap toward said post; and said strap having a socket receiving a protruding member inserted into said entry access.

2. A microwave oven comprising:

an oven body defining a cooking chamber and a door displaceably mounted to the body to close said chamber;

one of said door and said body having a switch arrangement recessed from an access entry and actuated by a probe mounted to the other of said door and said body, wherein said switch arrangement includes at least one actuator retracted from said access entry receiving said probe; and a protector including a post positioned at a first end of said access entry, a strap, and a mount for retaining a first end of said strap adjacent an opposite end of said access entry, for resiliently urging an opposite end of said strap toward said post; said strap having a socket for receiving a protrusion inserted to said entry access.

3. The invention as described in claim 2 wherein said probe includes a lateral prong.

4. The invention as described in claim 3 wherein said lateral prong and said cavity includes mating sliding surfaces.

5. The invention as described in claim 2 wherein said mount includes a pivot.

6. The invention as described in claim 5 wherein said mount includes a spring portion for resiliently displacing said strap about said pivot.

7. A method of protecting a switch arrangement positioned for engagement with a probe inserter through an access entry, the switch being aligned at a retracted position from said access entry, the method comprising:

restricting a portion of said access entry with a post;

obstructing access to a said switch by mounting a first end of a strap adjacent an opposite end of said access entry, and resiliently urging a second end of said strap toward said post;

receiving an inserted protruding member in a socket on said strip; and aligning a socket formed on said strap to said access entry.

* * * * *